US006508468B1

(12) United States Patent
Challice

(10) Patent No.: US 6,508,468 B1
(45) Date of Patent: Jan. 21, 2003

(54) TILE SEQUENCING GAME ASSEMBLY

(76) Inventor: Kevin F. Challice, 16 Houston Street, Millbrook Ontario (CA), L0A 1G0

( * ) Notice: Subject to any disclaimer, the term of this patent is extended or adjusted under 35 U.S.C. 154(b) by 0 days.

(21) Appl. No.: 09/948,738

(22) Filed: Sep. 7, 2001

(51) Int. Cl.[7] ..... A63F 3/00
(52) U.S. Cl. ..... 273/272
(58) Field of Search ..... 273/264, 271, 273/272, 299

(56) References Cited

U.S. PATENT DOCUMENTS

| | | | | |
|---|---|---|---|---|
| 937,796 | A | | 10/1909 | Hallock |
| D55,482 | S | | 6/1920 | Mc Intyre et al. |
| 1,474,504 | A | | 11/1923 | Allen |
| 2,752,158 | A | * | 6/1956 | Brunot et al. |
| 3,396,972 | A | * | 8/1968 | Smith |
| 3,869,124 | A | | 3/1975 | Stein et al. |
| 3,877,703 | A | * | 4/1975 | Pierre |
| 3,904,207 | A | * | 9/1975 | Gold |
| 4,244,580 | A | * | 1/1981 | Hoyles |
| 4,283,058 | A | * | 8/1981 | de Cadier |
| 4,565,374 | A | * | 1/1986 | Pak |
| 4,659,085 | A | * | 4/1987 | DeVries |
| 4,902,021 | A | | 2/1990 | Burroughs |
| 5,346,224 | A | | 9/1994 | Remus |
| 5,566,942 | A | * | 10/1996 | Elum |

* cited by examiner

*Primary Examiner*—William M. Pierce

(57) ABSTRACT

A tile sequencing game assembly for entertaining a plurality of players. The tile sequencing game assembly includes a plurality of tile game pieces having a point value. Numerical indicia are marked on each of the tile game pieces for indicating a predetermined order of positioning of each of the tile game pieces. A game board is provided for receiving the plurality of tile game pieces. The game board includes a plurality of game squares indicia marked thereon. Each of the players takes a turn positioning as many tile game pieces, in the predetermined order, on the game board as possible with more points being awarded for positioning more of the tile game pieces. Each of the players uses at least one of the tile game pieces already positioned on the game board with the player accumulating the highest number of points winning the game.

6 Claims, 1 Drawing Sheet

TILE SEQUENCING GAME ASSEMBLY

BACKGROUND OF THE INVENTION

1. Field of the Invention

The present invention relates to tile sequencing games and more particularly pertains to a new tile sequencing game assembly for entertaining a plurality of players.

2. Description of the Prior Art

The use of tile sequencing games is known in the prior art. More specifically, tile sequencing games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,474,504; 5,346,224; 3,896,124; 4,902,021; 937,796; and U.S. Patent No. Des. 55,482.

While these devices fulfill their respective, particular objectives and requirements, the aforementioned patents do not disclose a new tile sequencing game assembly. The inventive device includes a plurality of tile game pieces. Each of the tile game pieces has a single point value. A numerical indicia is marked on each of the tile game pieces for indicating a predetermined order of positioning each of the tile game pieces. A container is provided for mixing and storing the plurality of tile game pieces. A game board is provided for receiving the plurality of tile game pieces. The game board includes a plurality of game squares indicia marked thereon. Each of the players takes a turn positioning as many tile game pieces in the predetermined order on the game board, with more points being awarded for positioning more of the tile game pieces. Each of the players using at least one of the tile game pieces already positioned on the game board. A player wins the game by accumulating the highest number of points.

In these respects, the tile sequencing game assembly according to the present invention substantially departs from the conventional concepts and designs of the prior art, and in so doing provides an apparatus primarily developed for the purpose of entertaining a plurality of players.

SUMMARY OF THE INVENTION

In view of the foregoing disadvantages inherent in the known types of tile sequencing games now present in the prior art, the present invention provides a new tile sequencing game assembly construction wherein the same can be utilized for entertaining a plurality of players.

The general purpose of the present invention, which will be described subsequently in greater detail, is to provide a new tile sequencing game assembly apparatus and method which has many of the advantages of the tile sequencing games mentioned heretofore and many novel features that result in a new tile sequencing game assembly which is not anticipated, rendered obvious, suggested, or even implied by any of the prior art tile sequencing games, either alone or in any combination thereof.

To attain this, the present invention generally comprises a plurality of tile game pieces. Each of the tile game pieces has a single point value. A numerical indicia is marked on each of the tile game pieces for indicating a predetermined order of positioning each of the tile game pieces. A container is provided for mixing and storing the plurality of tile game pieces. A game board is provided for receiving the plurality of tile game pieces. The game board includes a plurality of game squares indicia marked thereon. Each of the players takes a turn positioning as many tile game pieces in the predetermined order on the game board, with more points being,, awarded for positioning more of the tile game pieces. Each of the players using at least one of the tile game pieces already positioned on the game board. A player wins the game by accumulating the highest number of points.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tile sequencing game assembly apparatus and method which has many of the advantages of the tile sequencing games mentioned heretofore and many novel features that result in a new tile sequencing game assembly which is not anticipated, rendered obvious, suggested, or even implied by any of the prior art tile sequencing games, either alone or in any combination thereof.

It is another object of the present invention to provide a new tile sequencing game assembly which may be easily and efficiently manufactured and marketed.

It is a further object of the present invention to provide a new tile sequencing game assembly which is of a durable and reliable construction.

An even further object of the present invention is to provide a new tile sequencing game assembly which is susceptible of a low cost of manufacture with regard to both materials and labor, and which accordingly is then susceptible of low prices of sale to the consuming public, thereby making such tile sequencing game assembly economically available to the buying public.

Still yet another object of the present invention is to provide a new tile sequencing game assembly which provides in the apparatuses and methods of the prior art some of the advantages thereof, while simultaneously overcoming some of the disadvantages normally associated therewith.

Still another object of the present invention is to provide a new tile sequencing game assembly for entertaining a plurality of players.

Yet another object of the present invention is to provide a new tile sequencing game assembly which includes a plurality of tile game pieces. Each of the tile game pieces has a single point value. A numerical indicia is marked on each of the tile game pieces for indicating a predetermined order of positioning each of the tile game pieces. A container is provided for mixing and storing the plurality of tile game pieces. A game board is provided for receiving the plurality of tile game pieces. The game board includes a plurality of game squares indicia marked thereon. Each of the players takes a turn positioning as many tile game pieces in the predetermined order on the game board, with more points being awarded for positioning more of the tile game pieces. Each of the players using at least one of the tile game pieces already positioned on the game board. A player wins the game by accumulating the highest number of points.

Still yet another object of the present invention is to provide a new tile sequencing game assembly that helps players such as, for example, young children learn numbers.

Even still another object of the present invention is to provide a new tile sequencing game assembly that provides hours of enjoyment to the players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
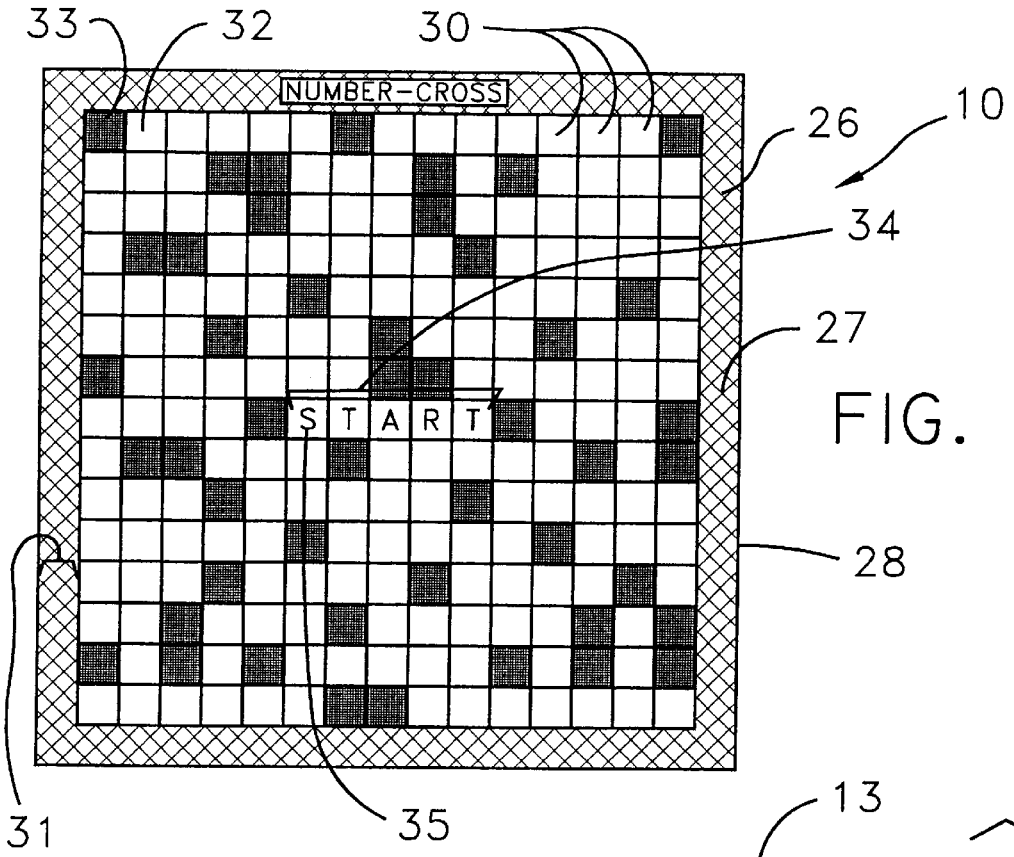
FIG. 1 is a schematic frontal view of a new tile sequencing game assembly according to the present invention.
Figure 3:
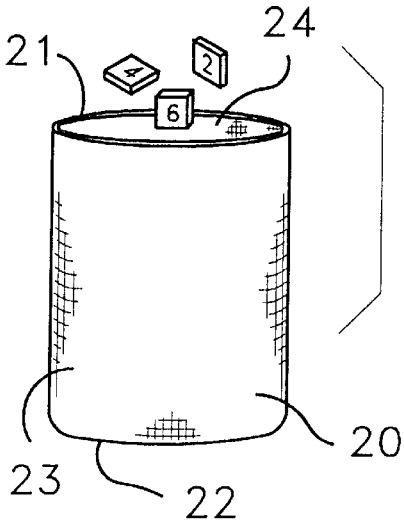
FIG. 3 is a schematic perspective view of the present invention showing a container.
Figure 2:
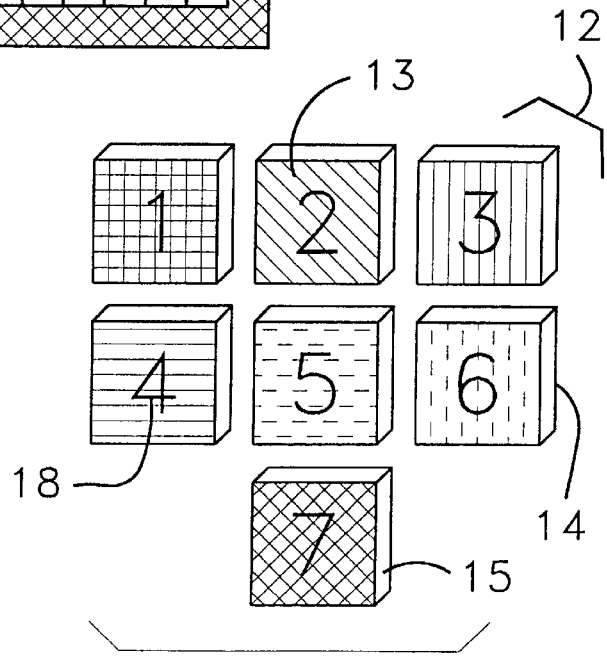
FIG. 2 is a schematic perspective view of the present invention showing a plurality of tile game pieces.

With reference now to the drawings, and in particular to FIGS. 1 through 3 thereof, a new tile sequencing game assembly embodying the principles and concepts of the present invention and generally designated by the reference numeral 10 will be described.

As best illustrated in FIGS. 1 through 3, the tile sequencing game assembly 10 generally comprises a plurality of tile game pieces 12. Each of the tile game pieces 12 includes an upper surface 13 and a lower surface 14. A peripheral edge surface 15 extends between the upper 14 and lower 15 surfaces of each of the tile game pieces 12. Each of the tile game pieces 12 preferably has a single point value. However, other point values may be given to the tile game pieces 12.

As illustrated in FIG. 2, numerical indicia 18 is marked on the upper surface 13 of each of the tile game pieces 12 for indicating a predetermined order of positioning of the plurality tile game pieces 12. In one embodiment of the present invention, as particularly illustrated in FIG. 2, the numerical indicia may include a number one numerical indicia marked on a portion of the plurality of tile game pieces 12, a number two numerical indicia marked on a portion of the plurality of tile game pieces 12, a number three numerical indicia marked on a portion of the plurality of tile game pieces 12, a number four numerical indicia marked on a portion of the plurality of tile game pieces 12, a number five numerical indicia marked on a portion of the plurality of tile game pieces 12, a number six numerical indicia marked on a portion of the plurality of tile game pieces 12 and a number seven numerical indicia marked on a portion of the plurality of tile game pieces 12. However, other values for the numerical indicia 18 may be employed.

In one embodiment of the present invention, each of the tile game pieces 12 may include a different color. Each of the colors corresponds to a particular numerical indicia 18 marked on the plurality of tile game pieces 12.

In one embodiment of the present invention, yellow and green may correspond to the number one and two numerical indicia respectively and the red and blue may correspond to the number four and five numerical indicia respectively. Additionally, gray and purple may correspond to the number five and six numerical indicia respectively, while orange may correspond to the number seven numerical indicia. Other colors may be employed to indicate the numerical indicia 18 marked on the plurality of tile game pieces 12.

As illustrated in FIG. 3, a container 20 may be provided for mixing the plurality of tile game pieces 12. The container may include an open first end 21 and a second end 22. A peripheral wall 23 may extend between the open first end 21 and the second end 22 defining an interior 24 of the container 20. In one embodiment of the present invention, the container 20 may comprise a substantially flexible material such as, for example, a cloth or plastic material.

As illustrated in FIG. 1, a game board 26 is provided for receiving the plurality of tile game pieces 12. The game board 26 includes a generally planar upper surface 27 and a perimeter edge 28. The upper surface 27 of the game board 26 includes a plurality of game squares indicia 30 marked thereon. In one embodiment of the present invention, the plurality of game squares indicia 30 may be arranged in a plurality of rows and columns.

The game board 26 may include a border indicia 31 marked thereon positioned generally adjacent to the perimeter edge 28 of the game board 26. The border indicia 31 are positioned such that it bounds the plurality of game squares indicia 30.

The game squares indicia 30 may include playing squares 32 and non-playing squares 33. In one embodiment of the present invention, each of the tile game pieces 12 is positionable on the playing squares 32 and not positionable on the non-playing squares 33. The non-playing squares 33 may include a different color than the playing squares 32 such as, for example, the playing squares 32 may be white while the non-playing squares 33 may be black.

The game board 26 may include a starting area 34 for receiving a first tile game piece 12 positioned on the game board 26 at the start of the game. In one embodiment of the present invention an alphabetical indicia 35 may be marked on a central portion of the upper surface 27 of the game board 26 for indicating the starting area 34.

As illustrated in FIG. 1, the alphabetical indicia 35 may comprise a plurality of letters spelling START. Each of the letters is preferably marked on one of the game squares indicia 30. Other letters may be employed to indicating the starting area 34.

The game board 26 may comprise a substantially rigid material such as, for example, a cardboard, wood or plastic material. Other materials may also be employed in the manufacture of the game board 26.

In use, a player places the plurality of tile game pieces 12 in the container 20 and shakes the container 20 to mix the plurality of tile game pieces 12. Each of the players takes a turn removing a portion of the plurality of tile game pieces 12 from the container. In one embodiment of the present invention, each of the players draws seven tile game pieces 12 from the container 20. In one embodiment of the present invention, each of the players draws another tile game piece 12 to determine whom positions the first tile game pieces 12 on the game board 26.

The player drawing the tile game piece 12 having the highest numerical indicia 18 goes first. In one embodiment of the present invention, the first player positions at least three tile game pieces 12 on the game board 26, with at least one being positioned on the start area. Each of the players takes a turn positioning as many tile game pieces 12 in a predetermined order on the game board 26 as possible. The players may position the tile game pieces 12 in a horizontal or vertical orientation on the game board 26.

In one embodiment of the present invention, the predetermined order may comprise placing during a turn as many tile game pieces 12 as possible on the game board having the same numerical indicia 18 such as, for example, tile game pieces all having the same value (e.g., all "1"s). In another embodiment of the present invention, the predetermined order may comprise placing during a turn as many tile game pieces 12 in increasing sequential order such as, for example, positioning tile game pieces 12 having the numbers one, two and three on the board. Optionally, the method of the invention may include permitting players to position tile game pieces on the game board according in either of the above described predetermined orders during the same game at the option of the player playing the turn.

The more of the tile game pieces 12 a player is able to position on the game board 26 during a turn, the more points the player accumulates. A scoring method for positioning the tile game pieces 12 on the game board may comprise:

| |
|---|
| 7 of the same kind of tile game pieces = 25 points |
| 6 of the same kind of tile game pieces = 20 points |
| 5 of the same kind of tile game pieces = 15 points |
| 4 of the same kind of tile game pieces = 10 points |
| 3 of the same kind of tile game pieces = 5 points |
| 7 tile game pieces in a sequence = 25 points |
| 6 tile game pieces in a sequence = 20 points |
| 5 tile game pieces in a sequence = 15 points |
| 4 tile game pieces in a sequence = 10 points |
| 3 tile game pieces in a sequence = 5 points |

In one embodiment of the present invention, if a player is unable to position more than two tile game pieces 12 on the game board 26 in any one turn, the player may exchange his or her group of game pieces 12 with other players or with tiles remaining in the container. The player may be limited by the other players to exchange up to five tile game pieces 12.

In one embodiment of the present invention, if a player positions all of his tile game pieces 12 on the game board 26 in one turn, the player is awarded a 25 point bonus. The player whom accumulates the highest number of points wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a tile sequencing game, said tile sequencing game including a plurality of tile game pieces, each of the tile game pieces having a single point value, a game board having a plurality of playing square indicia marked thereon, the game board having a starting area, a container for mixing and storing the tile game pieces comprising the steps of:

placing a portion of the plurality of tile game pieces by each of the players in the container;

removing a portion of the plurality of the tile game pieces by each of the players from the container;

positioning as many of the tile game pieces as possible on the game board in a predetermined order by a player during the player's turn using at least one of the tile game pieces already positioned on the game board if there are tile game pieces positioned on the game board prior to the player's turn;

additionally including the step of exchanging all of the tile game pieces with tiles in the container by one of the players if the player is unable to position at least three tile game pieces on the game board during a turn;

awarding points to a player based on a number of tiles game pieces that the player was able to place on the game board during each turn; and winning the game by accumulating the highest number of points.

2. The method of playing a tile sequencing game of claim 1, additionally including the step of determining what player goes first by drawing a tile game piece from the container by each of the players, and causing the player drawing tile game piece with the highest numerical indicia to take a first turn.

3. The method of playing a tile sequencing game of claim 1, additionally including the step of providing a bonus to a player positioning all of the player's tile game pieces on the game board in a single turn.

4. The method of playing a tile sequencing game of claim 1, wherein the step of positioning comprises placing on the game board as many tile game pieces as possible having the same numerical indicia thereon by each player during the player's turn.

5. The method of playing a tile sequencing game of claim 1, wherein the step of positioning comprises placing on the game board as many tile game pieces as possible in an increasing sequential order of the numerical indicia by each player during the player's turn.

6. The method of playing a tile sequencing game of claim 1, additionally including the steps of placing the plurality of tile game pieces in the container, and shaking the container by one of the players to mix the plurality of tile game pieces.

* * * * *